US005363985A

United States Patent [19]

Cornell

[11] Patent Number: 5,363,985

[45] Date of Patent: Nov. 15, 1994

[54] PAPER ARTICLE DISPENSER

[76] Inventor: Robert G. Cornell, 200 Crescent St., Duxbury, Mass. 02332

[21] Appl. No.: 219,814

[22] Filed: Mar. 28, 1994

Related U.S. Application Data

[63] Continuation of Ser. No. 126,667, Sep. 21, 1993, abandoned, which is a continuation of Ser. No. 654,235, Feb. 12, 1991, abandoned.

[51] Int. Cl.[5] ..... B65H 1/00

[52] U.S. Cl. ..... 221/46; 221/56; 221/58; 221/59

[58] Field of Search ..... 221/33, 44, 45, 46, 221/47, 48, 49, 51, 52, 56, 58, 59, 61, 197, 198, 226, 279, 281, 283, 282; 206/556, 233; 312/61, 71, 50

[56] References Cited

U.S. PATENT DOCUMENTS

| | | | |
|---|---|---|---|
| D. 332,114 | 12/1992 | Offenhauer et al. . | |
| 788,703 | 5/1905 | Casterline | 221/58 |
| 1,819,753 | 8/1931 | Morris . | |
| 1,909,919 | 5/1933 | Testi | 221/279 X |
| 2,464,426 | 3/1947 | Williams . | |
| 3,121,510 | 2/1964 | Holzwarth et al. | 221/60 |
| 3,307,740 | 3/1967 | Fant | 221/45 |
| 3,422,988 | 1/1969 | Franca | 221/58 |
| 3,724,716 | 4/1973 | Baraconi et al. | 221/58 X |
| 3,826,406 | 7/1974 | Moniot | 221/58 |
| 4,416,392 | 11/1983 | Smith | 221/59 X |
| 4,585,145 | 4/1986 | Pitroda | 221/58 |
| 4,653,666 | 3/1987 | Mertens | 221/45 |
| 4,735,317 | 4/1988 | Sussman et al. | 206/449 |
| 4,921,127 | 5/1990 | Windorski | 221/45 |
| 4,997,105 | 3/1991 | Fischer | 221/59 X |
| 5,116,012 | 5/1992 | Offenhauer et al. . | |

FOREIGN PATENT DOCUMENTS

| | | | |
|---|---|---|---|
| 1564918 | 4/1969 | France | 221/48 |

*Primary Examiner*—David H. Bollinger
*Attorney, Agent, or Firm*—Fish & Richardson

[57] ABSTRACT

A paper article dispenser including a housing for storing a stack of paper articles therein and a mechanism (such as a leaf spring) for urging the stack toward an opening in the housing to facilitate removal of one of the paper articles through the opening. The spring is configured and positioned to lie substantially flat within the housing when the spring is fully compressed. In another aspect, the base of the housing is constructed with integral, resilient members that bias the stack toward the opening.

44 Claims, 4 Drawing Sheets

PAPER ARTICLE DISPENSER

This is a continuation of application Ser. No. 08/126,667, filed Sep. 21, 1993, now abandoned, which is a continuation of application Ser. No. 07/654,235, filed Feb. 12, 1991, now abandoned.

BACKGROUND OF THE INVENTION

This invention relates to dispensers for stacks of paper articles.

A typical paper article dispenser includes a housing which stores a stack of paper articles, such as note slips. Individual note slips are removed through an opening in the top of the housing. Some dispensers include a spring positioned beneath the stack for biasing the stack towards the opening. This ensures that the uppermost note slip is located adjacent to the opening for easy removal.

One type of biasing spring is U-shaped and is oriented sideways in the housing so that one leg of the U rests against the bottom of the housing and the other leg engages the underside of the stack. Other dispensers use a similarly positioned helical spring instead.

SUMMARY OF THE INVENTION

A general aspect of the invention is a paper article dispenser in which the biasing spring is configured and positioned to lie substantially flat within the dispenser housing when the spring is fully compressed.

Preferred embodiments include the following features.

The spring is a layer of resilient material that is positioned on a surface of the housing opposite the opening through which the paper articles are removed. The spring expands out of the plane of the layer to urge the stack toward the opening to facilitate removal of one of the paper articles. The resilient layer is compressible to lie flat against the surface in the plane of the layer when a full stack of paper articles (such as note slips) are stored in the housing.

The spring force is applied to the stack equally along at least one dimension (such as the length) of the stack by constructing the resilient layer so that it includes a band that engages the underside of the stack along substantially the entire length of the stack. The band has downturned edges for stiffening and to avoid presenting sharp edges to the user.

The spring is a leaf spring. In one embodiment, the leaf spring is formed from curved stock to assume a generally curved configuration in the rest (i.e., fully expanded) state. In another embodiment, the leaf spring is made from a flat layer and is bent along one or more creases to expand the spring out of the plane of the layer.

Because the spring is compressible to substantially the thickness of the resilient layer, the space that it occupies in the housing when fully compressed is insignificant.

The spring includes one or more clips that engage corresponding tabs on the housing to maintain the spring in position beneath the stack. The dispenser housing includes an element (e.g., a magnet or an adhesive pad) for attaching the housing to an external surface.

In another general aspect, the need for a separate spring is avoided by constructing the base of the paper article dispenser to an integral spring. That is, part of the base provides the means for resiliently urging the stack towards the dispenser opening.

Preferred embodiments include the following features.

The base includes one or more resilient fingers that are integrally formed with the planar portion of the base (such as from polycarbonate). The fingers meet the planar portion of the base at a beaded joint for added strength. To provide maximum travel (i.e., from the fully compressed state to the fully expanded state) the joint is located at the underside of the flat portion of the base.

The fingers are thin to provide the necessary resiliency and include enlarged tips that engage the underside of the stack to bias the stack away from a planar surface of the base toward the opening. The base includes a recess, and the fingers are curved so that they move into the recess when a full stack of paper articles is stored in the dispenser.

The invention eliminates the need to set aside additional space in the dispenser (necessary in dispensers which use U-shaped or helical springs) to accommodate the height of the fully compressed spring. As a result, the dispenser is quite compact and simple to manufacture and assemble.

Other features and advantages of the invention will become apparent from the following detailed description, and from the claims.

DESCRIPTION OF THE PREFERRED EMBODIMENT

STRUCTURE AND OPERATION

Figure 1:
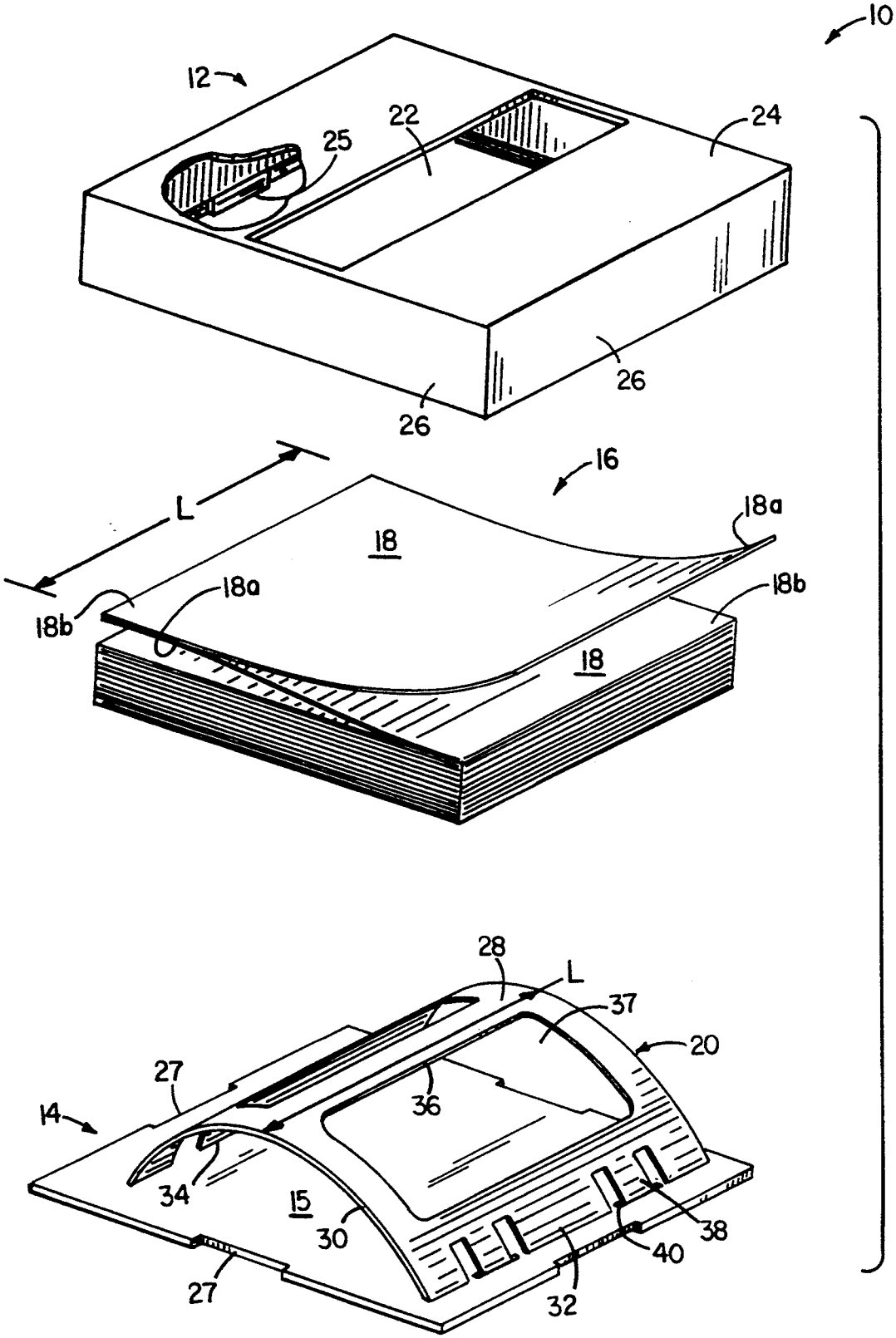
FIG. 1 is an exploded view of the paper article dispenser of the invention and a stack of paper articles.
Figure 2:
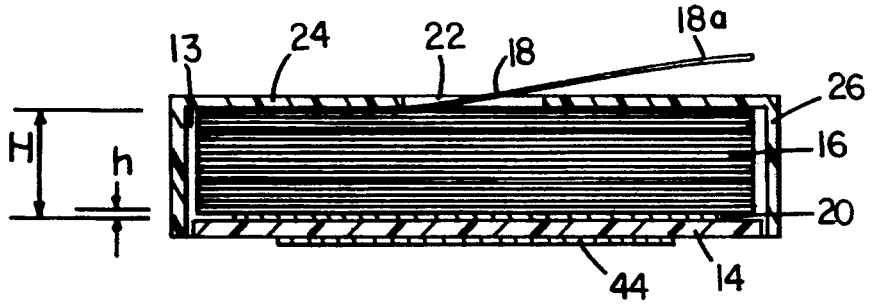
FIGS. 2 and 3 are cross-sectional views of the dispenser of FIG. 1 with a full stack (FIG. 2) and with a partially depleted stack (FIG. 3).
Figure 3:
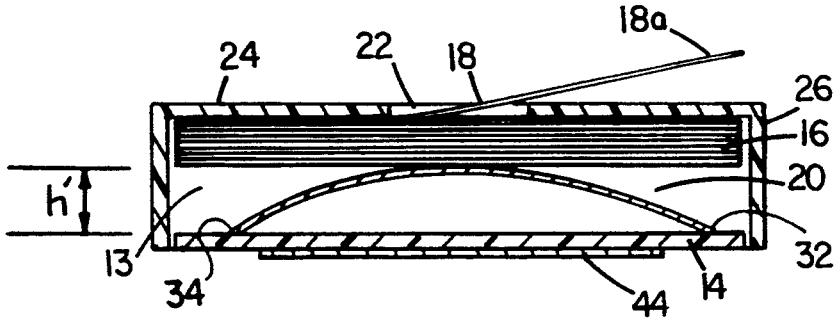

Referring to FIGS. 1–3, paper article dispenser 10 comprises a plastic housing that includes a body 12 and a base 14 which, when secured together, define a cavity 13 that encloses a stack 16 of note slips 18. A leaf spring 20 is positioned between the upper surface 15 of base 14 and the underside of stack 16 for urging stack 16 toward a rectangular slot 22 in the lid 24 of body 12 to facilitate removal of individual note slips 18 through slot 22 and help ensure that individual note slips 18 are removed one slip at a time.

Note slips 18 are, for example, the well-known fan folded "Post-It" ® note slips available from the 3M Company. Each note slip 18 includes a free end **18*a* that protrudes through slot 22 when that note slip 18 is at the top of stack 16. The opposite end 18*b* of each note slip 18 is loosely adhered to the free end 18*a* of the next-lowest note slip 18 in stack 16. As a result, as the uppermost slip 18 is removed, its adhesive end 18*b* pulls the free end 18*a* of the next lowest slip through slot 22 so that the next lowest slip is easily accessible for subsequent removal. Leaf spring 20 serves to press stack 16 against the underside of lid 24 so that the uppermost slip 18 is prevented from pulling the next-lowest slip 18 completely out of dispenser 10. Thus, spring 20 helps assure that only one slip 18 is removed at a time from dispenser 10**.

The sides 26 of dispenser body 12 include clips 25 for engaging corresponding notches 27 in base 14 to secure body 12 to base 14 (only one clip 25 and notch 27 are shown in FIG. 1). The housing is opened to replace a depleted stack 16 by disengaging clips 25 from notches 27. The height of sides 26 is selected so that the height H of cavity 13 (FIG. 2) closely approximates the thickness of a full stack 16 of note slips 18 stored in the housing. (The spaces in FIG. 2 are shown enlarged for clarity.) The geometry of dispenser body 12 and base 14 conforms to that of note slips 18 (i.e., square as shown in the figures), and the length and width of body 12 and base 14 are only slightly larger than those of stack 16. Dispenser 10 is thus quite compact and takes up little space in addition to the volume occupied by stack 16.

Leaf spring 20 is made from a thin (approximately 0.0055 inches thick) planar layer of resilient stainless steel. Leaf spring 20 is formed (such as by stamping) from a curved sheet of metal and has a height of about ¾ inch when in its fully expanded, or rest, condition (shown in FIG. 1) so that the upper surface of leaf spring 20 bears against the lower surface of lid 24 when note paper stack 16 is fully depleted. This assures that stack 16 is urged against the lower surface of lid 24 even when stack 16 is nearly depleted.

Leaf spring 20 is compressible against base 14 to a height h equal to its thickness (spring 20 is shown fully compressed in FIG. 2). That is, spring 20 is substantially planar (i.e., flat) when fully compressed, and as a result occupies very little height in cavity 13 in addition to the height H needed to accommodate a full stack 16 of note slips 18. (In fact, because stack 16 is softer than spring 20, the spring may impress itself into stack 16 when fully compressed and thereby take up no height in cavity 13 beyond that occupied by stack 16.)

Leaf spring 20 includes a pair of opposing arms 28, 30 connected together at their ends by a pair of opposing sides 32, 34 to form a frame that has a length and width approximately equal to the length and with of each note slip 18. Spring 20 is resilient along its length, and thus arms 28, 30 deflect out of the plane of the layer when spring 20 expands. A band 36 is disposed between arms 28, 30 at approximately their midpoints to provide a surface that remains in contact with the underside of stack 16 along the entire length L of stack 16 as spring 20 expands. The remainder of the interior of the frame is cut out with a pair of rectangular holes 37 to reduce the weight of spring 20 and increase its resiliency.

Figure 4:
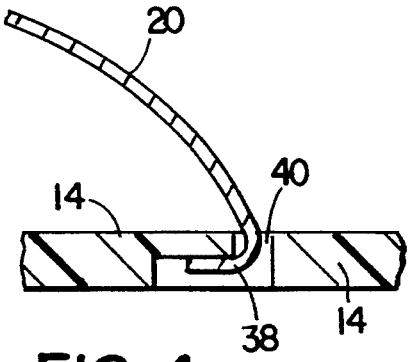
FIG. 4 is an enlarged view of a portion of the paper article dispenser of FIGS. 1–3.

Referring also to FIG. 4, side 32 includes a pair of clips 38 that engage a corresponding pair of undercut slots 40 that form tabs in base 42. This allows spring 20 to be secured to base 14 directly beneath stack 16 and to be removed when necessary.

A magnetized pad 44 (FIGS. 2 and 3) is secured to the underside of base 14 to allow dispenser 10 to be conveniently mounted to metal objects, such as the surface of a desk, a household appliance (e.g., a refrigerator), and the like. Alternatively, the underside of pad 44 can be coated with an adhesive or include a velcro surface.

In operation, with dispenser body 12 disengaged from base 14, a full stack 16 of note slips 18 is loaded by placing stack 16 on spring 20, feeding the free end **18*a* of the uppermost slip 18 through slot 22, and then fastening dispenser body 12 to base 14 by snapping clips 25 into notches 27. Lid 24 thus urges stack 16 downward, overcoming the force of spring 20 and compressing it flat against base 14 (FIG. 2**).

The uppermost note slip 18 is removed from dispenser 10 by grasping free end **18*a* and pulling slip 18 upward through slot 22. As the top note slip 18 is withdrawn, its adhesive end 18*b* pulls the free end 18*a* of the next-lowest note slip 18 through slot 22 so that it can be readily removed from dispenser 10. This operation is assisted by spring 20, which resiliently biases stack 16 away from base 14 upward against lid 24. Leaf spring 20, by urging stack 16 against the underside of lid 24, helps prevent the next-lowest note slip 18 from being completely removed from dispenser 10 together with the uppermost note slip 18**.

As shown in FIG. 3, withdrawing additional note slips 18 reduces the thickness of stack 16, allowing spring 20 to expand from its fully compressed state. Because side 32 is held in position on base 14 by the engagement of clips 38 in undercut slots 40, the resiliency of spring 20 causes opposite side 34 to slide along upper base surface 15 toward anchored side 32, and as a result opposing arms 28, 30 arch upward, away from base 14 and toward lid 24.

Spring 20 thus lifts stack 16 away from base 14, thereby occupying a progressively larger height h' in cavity 13 and maintaining stack 16 against lid 24. The expansion force of spring 20 is applied against the underside of stack 16 equally along the entire length L (FIG. 1) of stack by band 36. This helps avoid tearing that can occur if the spring force applied to the center of stack 16 is significantly less than that exerted against stack 16 at its edges.

Other embodiments are within the scope of the following claims.

For example, spring 20 can be disposed in a rectangular or square recess in base 14 so that when fully compressed the spring will lie flush with the upper surface 15 of base 14 and thus occupy no height in cavity 13.

Spring 20 can alternatively be constructed from one or more individual leaf springs each of which includes a single arm of resilient material. Spring 20 can also be made from other suitable materials (e.g., spring steel or plastic).

Figure 5:
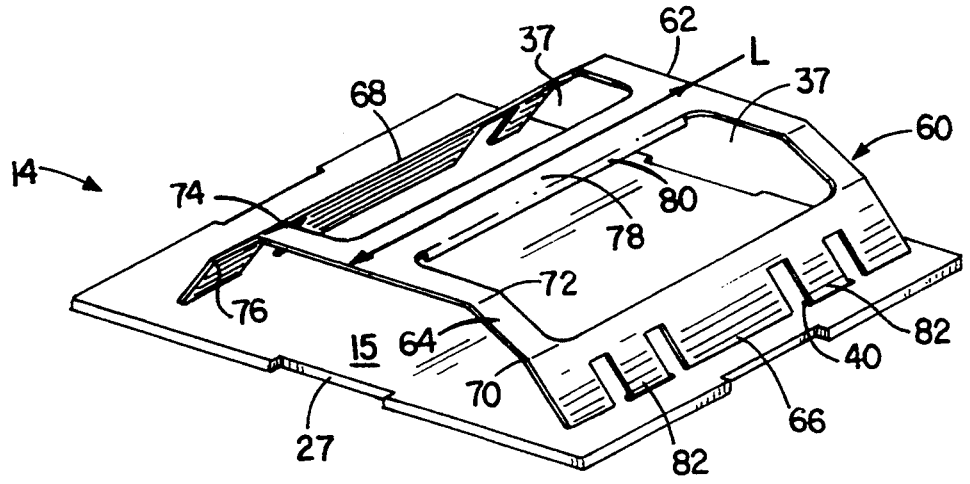
FIGS. 5–7 show an alternative embodiment of the paper article dispenser of the invention.
Figure 6:
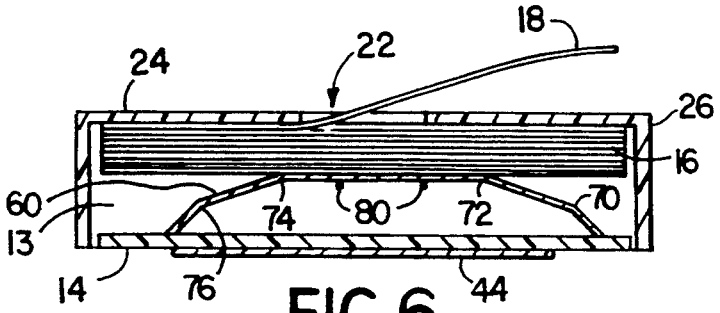
Figure 7:
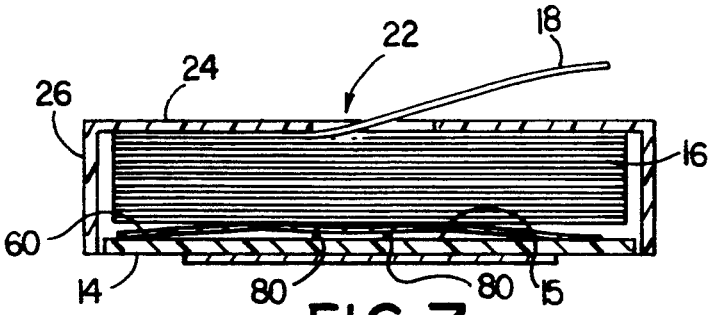

Referring to FIGS. 5–7, leaf spring 60 is fabricated, such as by stamping, from a flat metal sheet rather than from curved stock. Like spring 20, spring 60 is a thin layer of material in the shape of a frame and includes a pair of opposing arms 62, 64, the ends of which are connected together by a pair of sides 66, 68. Spring 60 is bent along four parallel creases 70, 72, 74, 76 to expand spring 60 out of the plane of the layer by approximately ½ inch.

When fully expanded, the central region of spring 60, which includes the band 78 that connects arms 62, 64 and the lengths of arms 62, 64 disposed between creases 72, 74, lies generally parallel to the upper surface 15 of base 14 and contacts the underside of the stack 16 of note slips 18 (FIG. 6). This provides increased support for stack 16 and more uniform pressure of stack against the underside of lid 24.

The edges of band 78 are turned downward with respect to the upper surface of band 78 to form thin perpendicular rails 80. Rails 80 provide band 78 with increased resistance to deflection in a direction perpendicular to the upper surface of band 78, thereby stiffening band 78 and providing added support for the stack of note slips. Rails 80 also serve to provide band 78 with rounded edges, thereby decreasing the risk of cutting the user's fingers. Spring 60 is secured to base 14 with a pair of clips 82 in arm 66 that engage the undercut slots 40 in base 14 (see FIG. 4).

When a full stack 16 of note slips is installed in dispenser 10 (FIG. 7), spring 60 is compressed to lie substantially, but not completely, flat against upper base surface 15. That is, spring 60 is compressed substantially, but not entirely, into the plane of the layer. Only creases 70–76 and rails 80 prevent spring 60 from lying completely flat. However, the increase in the compressed height of the spring is minimal.

Figure 8:
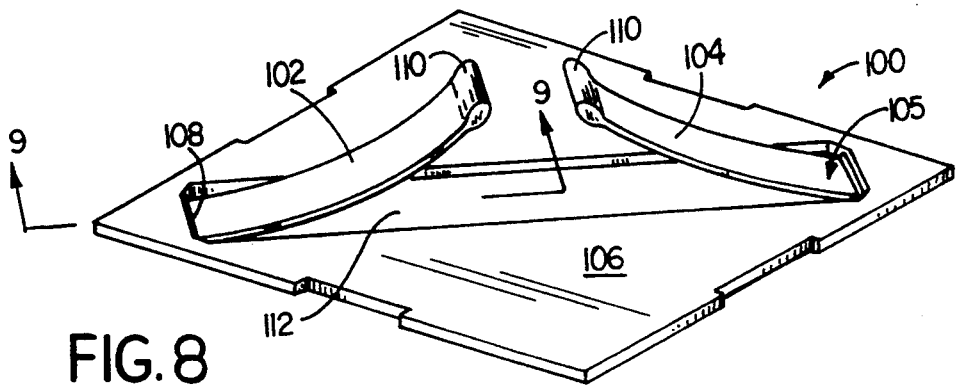
FIGS. 8–11 show a paper article dispenser according to yet another embodiment of the invention.
Figure 9:
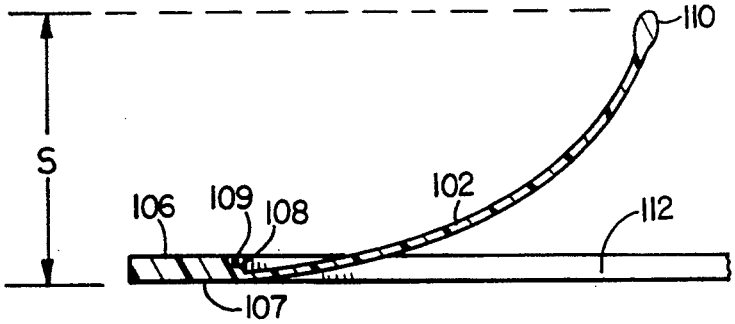

Referring to FIGS. 8 and 9, in yet another embodiment, the spring for biasing the stack 16 of note slips 18 against the underside of lid 24 is integral with the base of the note paper dispenser and comprises a pair of resilient, opposing fingers 102, 104. Fingers 102, 104 are formed together as a single unit with base 100, such as by injection molding base 100 and fingers 102, 104 from polycarbonate. A rectangular recess 112 is disposed in the planar portion 106 of base 100 under fingers 102, 104 and extends completely through base 100.

Fingers 102, 104 are thin relative to the thickness (about 3/16 inch) of the planar portion of base 100. Each finger 102, 104 is about ½ inch wide and meets the flat portion 106 of base 100 at a joint 105 formed at the underside 107 of base 106. Extending horizontally along the top of each joint 105 is small, rounded bead 108 which forms a bridge between the surface of finger 102, 104 and a vertical edge 109 of recess 112. Beads 108 serve to reinforce joints 105 for increased durability.

Fingers 102, 104 are curved through a radius of curvature of about two inches for purposes to be described. Fingers 102, 104 have a thickness of approximately 0.035 inches throughout most of their lengths, but the tip 110 of each finger (which bears against the underside of note paper stack 16, particularly when the stack is nearly depleted) is somewhat enlarged for increased strength. Each finger 102, 104 is about 2½ inches long so that tips 110 are spaced by approximately ⅝ inches when fingers 102, 104 are fully extended from flat portion 106.

When fingers 102, 104 are fully extended (i.e., when the spring formed by fingers 102, 104 is in the fully relaxed state), the total distance S between underside 107 of base 100 and finger tips 110 is approximately ⅞ inch. Fingers 102, 104 thus stand slightly higher than springs 20 (FIG. 1) or 60 (FIG. 5). This is done because fingers 102, 104 tend to relax slightly and loose some of their overall height over time. The increased initial height helps ensure that fingers 102, 104 maintain adequate pressure against note paper stack 16 (to prevent removal of more than one note slip at a time from the dispenser) despite this relaxation.

Figure 10:
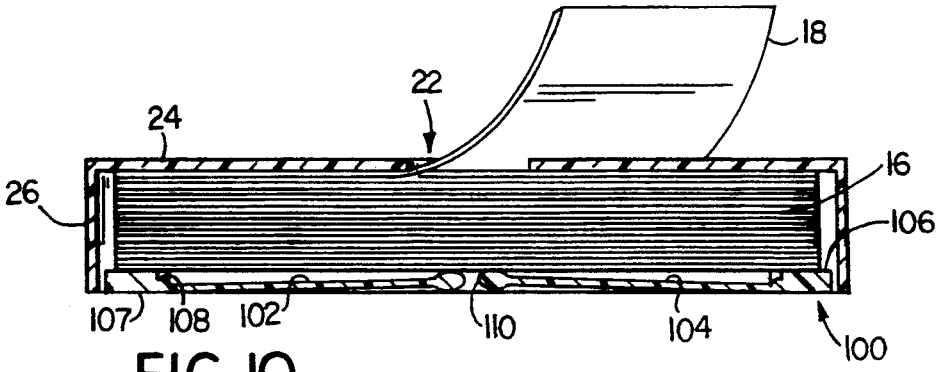

Referring to FIG. 10, in operation, when a full stack 16 of note slips is installed in the dispenser, stack 16 is compressed between lid 24 and urges fingers 102, 104 into recess 112 (i.e., the spring formed by fingers 102, 104 is fully compressed). The curved configuration of fingers 102, 104, as well as the location of joints 105 at the underside 107 of flat base portion 106, allows fingers 102, 104 to withdraw completely into recess 112. (By contrast, due to the stiffness of the joint between fingers and flat base portion 106, a straight finger would tend to protrude slightly from recess 112 near the joint.) Boss-shaped tips 110 also lie substantially completely within recess 112. As a result, the underside 17 of note paper stack 16 is permitted to rest against (or perhaps just slightly above) the upper surface of flat base portion 106.

The removal of individual note slips 18 from the dispenser proceeds in the same fashion as that discussed above. Fingers 102, 104 continually urge stack 16 upward, biasing the stack against the underside of lid 24 to ease the removal of the uppermost note slip 18 through slot 22 and helping to prevent the uppermost note slip 18 from pulling the next-lowest note slip 18 completely out of the dispenser as the uppermost note slip 18 is removed.

Figure 11:
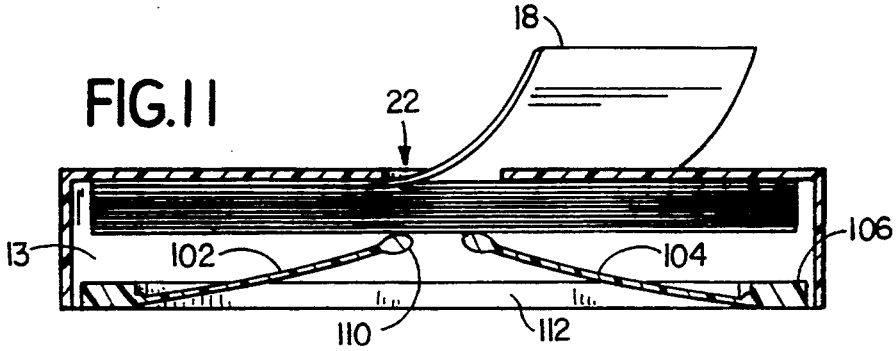

Referring also to FIG. 11, as additional paper slips 18 are removed and the thickness of stack 16 is decreased, fingers 102, 104 flex upward (i.e., the spring formed by fingers 102, 104 expands), continually and resiliently urging stack 16 against the underside of lid 24. The tips 110 of fingers 102, 104 are maintained in constant contact with stack 16.

Still other embodiments are within the scope of the claims.

For example, the dispenser can be used with other paper articles, such as tissue paper, napkins, or paper towels. The size and shape of the housing (as well as the slot through which the articles are removed) can be altered to accommodate paper articles having other shapes, and stacks having different thicknesses, than those discussed above.

Fingers 102, 104 can be straight rather than curved and can be made from other suitable materials. Polycarbonate is presently preferred due to the high degree of "memory" (i.e., a characteristic whereby the material retains its shape (such as curved) and deflection properties after long periods of storage and use) that it possesses.

I claim:

1. A paper article dispenser comprising a housing for storing therein a stack of paper articles, said stack being having a generally rectangular shape and a selected width dimension, and a spring for contacting and urging said stack toward an opening in said housing to facilitate removal of one of said paper articles through said opening, said spring comprising a layer of resilient material that is configured and positioned in said housing to lie substantially flat within said housing in a plane of said layer when fully compressed, said layer of resilient material including:

a pair of opposing arm portions having end regions that are spaced by a pair of opposing side portions to define a generally rectangular shape, said arm portions being configured to expand out of a plane of said layer to urge said stack toward said opening, and a band portion disposed between said arm portions at intermediate regions thereof, said band portion and said intermediate regions being configured to contact said stack over substantially the selected width thereof as said arm portions expand out of said plane.

2. The dispenser of claim 1 wherein said layer is positioned on a surface of said housing disposed opposite to said opening, said layer being compressible to lie substantially flat against said surface by a full stack of paper articles stored in said housing.

3. The dispenser of claim 1 wherein said layer further comprises an angled region for stiffening said band portion.

4. The dispenser of claim 1 wherein said layer of resilient material is further constructed to be secured to said housing.

5. The dispenser of claim 4 wherein one of said side portions of said layer includes at least one clip for engaging a corresponding tab on said housing.

6. The dispenser of claim 1 wherein said housing includes means for attaching said housing to an external surface.

7. The dispenser of claim 1 wherein said layer of material is constructed to be resiliently compressible from a rest condition in which said layer is expanded out of the plane thereof to a compressed condition in which said layer is disposed substantially in said plane by disposing a full said stack of paper articles in said housing.

8. The dispenser of claim 7 wherein said layer has a curved configuration in said rest condition.

9. The dispenser of claim 7 wherein said layer is bent along at least one crease to expand said layer out of said plane in said rest condition.

10. The dispenser of claim 1 wherein said spring is a leaf spring.

11. The dispenser of claim 1 wherein said stack comprises a series of paper articles adjacent ones of which are adhered to each other along alternating sides thereof.

12. The dispenser of claim 1 wherein said layer of resilient material defines at least one opening between said arm portions.

13. The dispenser of claim 1 wherein said layer of resilient material defines a plurality of openings, each one of said openings being bounded by said band portion, one of said end portions, and said pair of arm portions.

14. A paper article dispenser comprising a housing for storing a stack of paper articles in a cavity thereof, said housing including a base for supporting said stack, said base being constructed to include a plurality of generally opposing resilient members integrally formed with said base as a single unit, each of said resilient members having a first end attached to said base and a second end for engaging said stack and biasing said stack away from said base toward an opening in said housing to facilitate removal of one of said paper articles through said opening, each one of said resilient members being configured to contact said stack substantially only at said second end, said resilient members being constructed to be urged toward said base by a full stack of paper articles to a position in which said members are disposed substantially outside of said cavity.

15. The dispenser of claim 14 wherein said base has a generally planar upper surface, plurality of resilient members being constructed to move out of the plane of said base to bias said stack toward said opening.

16. The dispenser of claim 14 wherein plurality of resilient members each includes an intermediate region between said first end and said second end, said intermediate region being curved away from said stack.

17. The dispenser of claim 14 wherein said base comprises polycarbonate.

18. The paper article dispenser of claim 14, wherein said base further includes a recess positioned to receive at least a portion of each of said resilient members when said resilient members are urged toward said base by said full stack of paper articles.

19. A paper article dispenser comprising a housing for storing a stack of paper articles therein, said housing including a base for supporting said stack, said base having a generally planar upper surface, said base including a plurality of generally opposing members for engaging said stack and moving out of the plane of said base to bias said stack away from said base and resiliently urge said stack toward an opening in said housing to facilitate removal of one of said paper articles through said opening, said resilient members being formed with said base as a single unit, said base including a recess and said members being constructed to be resiliently urged into said recess by a full stack of paper articles stored in said housing to allow said full stack to be disposed substantially flat against said upper surface.

20. A paper article dispenser comprising a housing for storing a stack of paper articles therein, said housing including a base for supporting said stack, said base being constructed to included at least one resilient member having a first end attached to said base and a second end for engaging said stack and biasing said stack away from said base toward an opening in said housing to facilitate removal of one of said paper articles through said opening, said resilient member being configured to contact said stack substantially only at said second end, said member being integrally formed with said base as a single unit.

21. The dispenser of claim 20 wherein said first end of said member meets said base at a joint, at least a portion of said joint having a rounded shoulder to reinforce said joint.

22. The dispenser of claim 21 wherein said joint is disposed at an underside of said planar portion.

23. A paper article dispenser comprising a housing for storing a stack of paper articles therein, said housing including a base for supporting said stack, said base including at least one member for engaging said stack and biasing said stack away from said base to resiliently urge said stack toward an opening in said housing and facilitate removal of one of said paper articles through said opening, said at least one member having an enlarged tip that engages said stack.

24. A paper article dispenser comprising a housing for storing a stack of paper articles in a cavity of said housing, said housing including a base for supporting said stack, a planar surface of said base defining a boundary of said cavity, said base comprising a pair of integrally formed, opposing members that project into said cavity from a recess in said base, said members resiliently biasing said stack toward an opening in said housing to facilitate removal of one of said paper articles from said housing, said members being constructed to be urged into said recess and substantially out of said cavity by a full stack of paper articles stored in said housing.

25. A paper article dispenser comprising a housing for storing a stack of paper articles in a cavity thereof, said housing including a base of predetermined thickness for supporting said stack, said base being constructed to include a plurality of generally opposing resilient members integrally formed with said base as a single unit, each of said resilient members having a first end attached to said base and a second end for engaging said stack and biasing said stack away from said base toward an opening in said housing to facilitate removal of one of said paper articles through said opening, said members being thin relative to said predetermined thickness of said base, said resilient members being constructed to be urged toward said base by a full stack of paper articles to a position in which said members are disposed substantially outside of said cavity.

26. A paper article dispenser comprising a housing for storing a stack of paper articles in a cavity thereof, said housing including a base for supporting said stack and an opening through which said articles are removed from a first side of said stack, said base being constructed to include a plurality of generally opposing resilient members integrally formed with said base as a single unit, each of said resilient members having a first end attached to said base and a second end for engaging a second side of said stack and biasing said stack away from said base toward said opening to facilitate removal of one of said paper articles through said opening, each one of said members being shaped so that it contacts said second side of said stack substantially only in a region that is aligned with said opening, said resilient members being constructed to be urged toward said base by a full stack of paper articles to a position in which said members are disposed substantially outside of said cavity.

27. The dispenser of claim 25 or 26 wherein said base includes a recess, said member being constructed to be resiliently urged into said recess by a full stack of paper articles stored in said housing.

28. A dispenser of claims 25 or 26 wherein said member includes an intermediate region between said first end and said second end, said intermediate region being curved away from said stack.

29. A paper article dispenser comprising a housing for storing a stack of paper articles therein, said housing including a base of predetermined thickness for supporting said stack, said base being constructed to include at least one resilient member having a first end attached to said base and a second end for engaging said stack and biasing said stack away from said base toward an opening in said housing to facilitate removal of one of said paper articles through said opening, said member being thin relative to said predetermined thickness of said base, said member being integrally formed with said base as a single unit.

30. A paper article dispenser comprising a housing for storing a stack of paper articles in a cavity thereof, said housing including a base for supporting said stack, said base being constructed to include a plurality of opposing resilient members integrally formed with said base as a single unit, each of said resilient members having a first end attached to said base and a second end for engaging said stack and biasing said stack away from said base toward an opening in said housing to facilitate removal of one of said paper articles through said opening, said resilient members being constructed to be urged toward said base by a full stack of paper articles to a position in which said members are disposed substantially outside of said cavity.

31. The dispenser of claim 30 wherein said base includes a recess, said members being constructed to be resiliently urged into said recess by a full stack of paper articles stored in said housing.

32. The dispenser of claim 30 wherein each of said members includes an intermediate region between said first end and said second end, said intermediate region being curved away from said stack.

33. The paper article dispenser of claim 14, 24, 25, 26, or 30 wherein said stack comprises a series of paper articles adjacent ones of which are adhered to each other along alternating sides thereof.

34. A paper article dispenser comprising a housing for storing a stack of paper articles therein, said housing including a base for supporting said stack, said base being constructed to include a pair of generally opposing resilient members each of which has a first end attached to said base and a second end for engaging said stack and biasing said stack away from said base toward an opening in said housing to facilitate removal of one of said paper articles through said opening, said members being integrally formed with said base as a single unit.

35. A paper article dispenser comprising a housing for storing a stack of paper articles therein, said housing including a base for supporting said stack and an opening through which said articles are removed from a first side of said stack, said base being constructed to include at least one resilient member having a first end attached to said base and a second end for engaging a second side of said stack and biasing said stack away from said base toward said opening to facilitate removal of one of said paper articles through said opening, said member being shaped to that it contacts said second side of said stack substantially only in a region that is aligned with said opening, said member being integrally formed with said base as a single unit.

36. The paper article dispenser of claim 20, 29 or 35 wherein said base is further constructed to include a second said resilient member for engaging said stack and biasing said stack away from said base toward said opening.

37. A paper article dispenser comprising a housing for storing therein a stack of paper articles, said stack having a selected width dimension, and a spring for contacting and urging said stack toward an opening in said housing to facilitate removal of one of said paper articles through said opening, said spring comprising a layer of resilient material that is configured and positioned in said housing to lie substantially flat within said housing in a plane of said layer when fully compressed, said layer of resilient material including:

a pair of spaced arms configured to expand out of a plane of said layer to urge said stack toward said opening, and a band disposed between said arms at intermediate regions thereof, said band and said intermediate regions being configured to contact said stack over substantially the selected width thereof as said arms expand out of said plane.

38. The dispenser of claim 37 wherein said layer is positioned on a surface of said housing disposed opposite to said opening, said layer being compressible to lie substantially flat against said surface by a full stack of paper articles stored in said housing.

39. The dispenser of claim 37 wherein said layer is positioned on a surface of said housing disposed opposite to said opening, each one of said arms having a pair of ends that contact said surface and being configured to expand between said ends to urge said stack toward said opening.

40. The dispenser of claim 39 wherein said pairs of ends of said arms are connected together by a pair of sides.

41. The dispenser of claim 40 wherein at least one of said sides includes a clip for engaging a corresponding tab on said housing to attach said layer to said housing.

42. The dispenser of claim 37 further comprising structure for stiffening said band.

43. The dispenser of claim 42 wherein said structure includes an angled region of said band.

44. The dispenser of claim 37 wherein said stack comprises a series of paper articles adjacent ones of which are adhered to each other along alternating sides thereof.

* * * * *